US006647907B1

(12) United States Patent
Long

(10) Patent No.: US 6,647,907 B1
(45) Date of Patent: Nov. 18, 2003

(54) CHAIN STITCH MACHINE

(76) Inventor: George Long, 1100 English Rd., High Point, NC (US) 27262

( * ) Notice: Subject to any disclaimer, the term of this patent is extended or adjusted under 35 U.S.C. 154(b) by 0 days.

(21) Appl. No.: 10/154,194

(22) Filed: May 22, 2002

(51) Int. Cl.[7] ..... D05B 55/14; D05B 5/00
(52) U.S. Cl. ..... 112/165; 112/221; 112/450
(58) Field of Search ..... 112/450, 165, 112/197, 475.17, 284, 220, 221

(56) References Cited

U.S. PATENT DOCUMENTS 1,212,256 A * 1/1917 Plumley ..... 112/220
1,269,650 A * 6/1918 Seymour ..... 112/284
1,929,321 A * 10/1933 Lutz ..... 112/197
2,729,179 A * 1/1956 Attwood ..... 112/220
3,986,469 A * 10/1976 Ketterer ..... 112/424
4,374,503 A * 2/1983 Ketterer ..... 112/168

* cited by examiner

*Primary Examiner*—Ismael Izaquirre
(74) *Attorney, Agent, or Firm*—Joseph N. Breaux

(57) ABSTRACT

An improved chain stitch sewing machine that includes a stitch skip mechanism that is activated by the sewing machine operator such that the operator may cause the sewing machine to skip stitches as desired.

1 Claim, 4 Drawing Sheets

CHAIN STITCH MACHINE

TECHNICAL FIELD

The present invention relates to chain stitch sewing machines and more particularly to an improved chain stitch sewing machine that includes a stitch skipping mechanism mechanically incorporated into the needle bar movement mechanism of a chain stitch sewing machine for allowing an operator to skip one or more stitches while the chain stitch sewing machine is operating.

BACKGROUND ART

Chain stitch sewing machines are often used to chain stitch sections of fabric together that will later be lock stitched together at a later step in the manufacturing process. Once the lock stitching has been accomplished, it is necessary to remove the chain stitching. It would be much easier to remove the temporary chain stitching if the line of chain stitches included several missed stitches which would allow a worker to easily grasp the chain stitched thread in a manner to easily pull on and unravel the section of chain stitching. It would be desirable, therefore, to have a chain stitch sewing machine that included a stitch skip mechanism that could be activated by an operator that would allow the operator to cause the chain stitch sewing machine to miss stitches while the stitch skip mechanism was activated.

GENERAL SUMMARY DISCUSSION OF INVENTION

It is thus an object of the invention to provide an improved chain stitch sewing machine having a needle bar movement mechanism including a pivoting needle bar drive lever having a needle bar attachment end, a pivot bushing disposed in a central portion thereof, and a hand wheel end mechanically linked to a drive motor through a crank shaft assembly of a chain stitch sewing machine such that, as a drive shaft of the drive motor rotates the crank shaft assembly, the needle bar attachment end of the pivoting needle bar drive lever is caused to reciprocate up and down in a timed fashion by pivoting against an exisiting hinge shaft having a bushing contact section concentrically aligned with other sections of the hinge shaft and positioned through the pivot bushing; the improvement comprising providing an operator activated hinge shaft angular orientation mechanism mechanically linked to an improved hinge shaft having two concentrically oriented end sections connected by an off-center bushing contact section that is dimensioned such that, when the improved hinge shaft is oriented at a first orientation by the operator activated hinge shaft angular orientation mechanism, the needle bar attachment end of the pivoting needle bar drive lever reciprocates between a normal upper and a normal lower position that causes the chain stitch swing machine to form a chain stitch during each cycle of operation; and that, when the improved hinge shaft is oriented at a second orientation by the operator activated hinge shaft angular orientation mechanism, the needle bar attachment end of the pivoting needle bar drive lever reciprocates between a raised upper and a raised lower position that causes the chain stitch swing machine to skip a chain stitch during each cycle of operation.

Accordingly, an improved chain stitch sewing machine with a stitch skip mechanism is provided.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
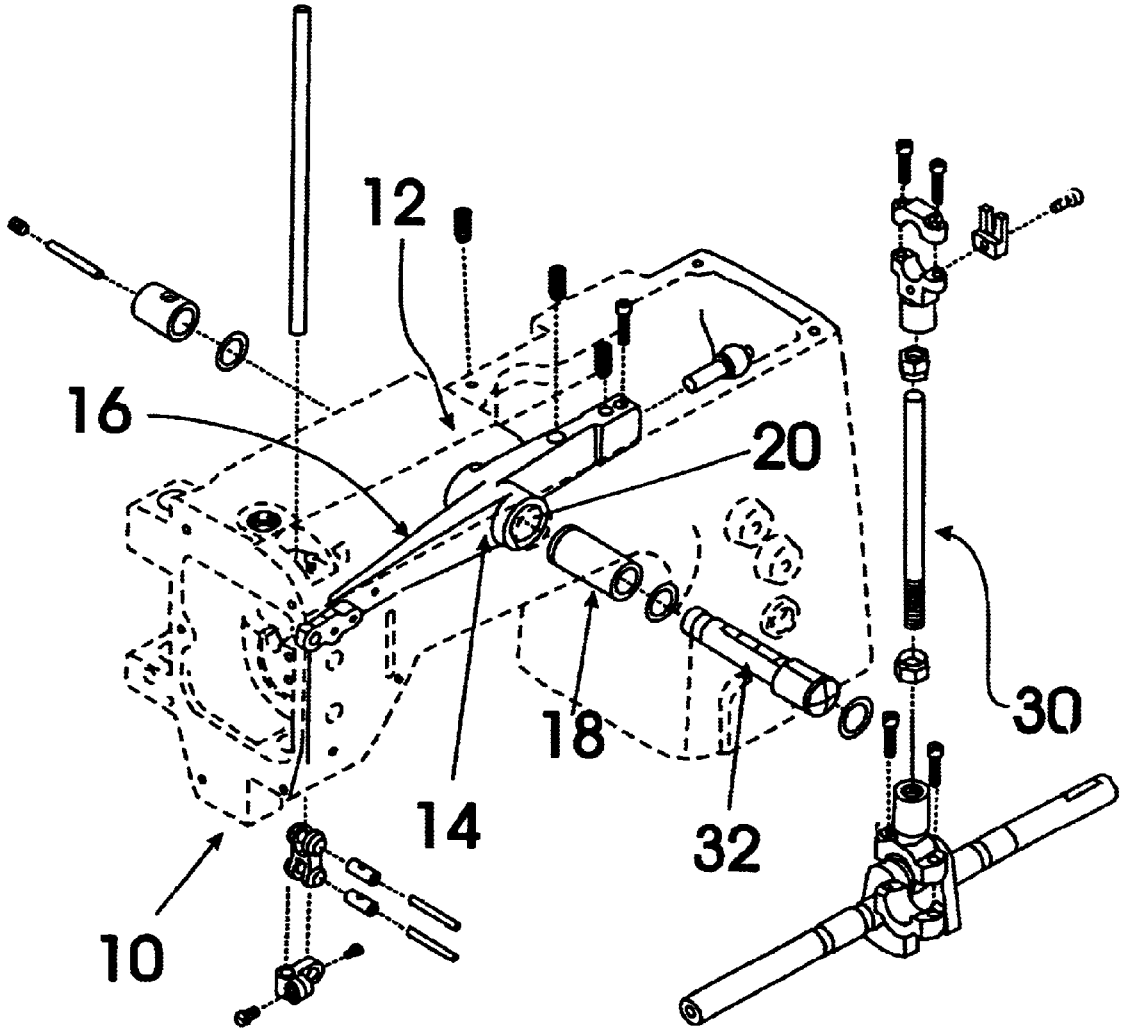
FIG. 1 is an exploded perspective view of a representative needle bar movement mechanism of a representative chain stitch sewing machine for which the improvement of the present invention is suited.
Figure 2:
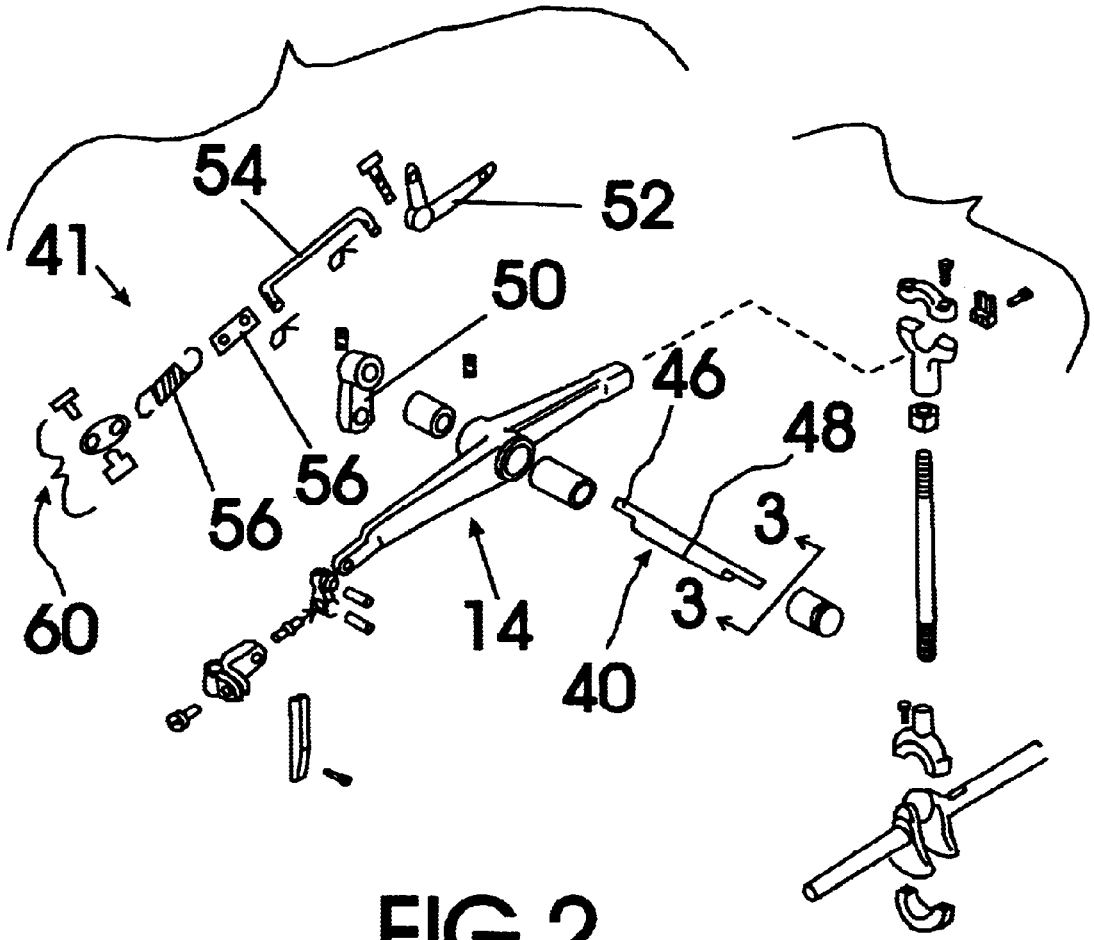
FIG. 2 is an exploded perspective view of the stitch skip mechanism improvement of the present invention in connection with the representative needle bar movement mechanism of the representative chain stitch sewing machine of FIG. 1.
Figure 3:
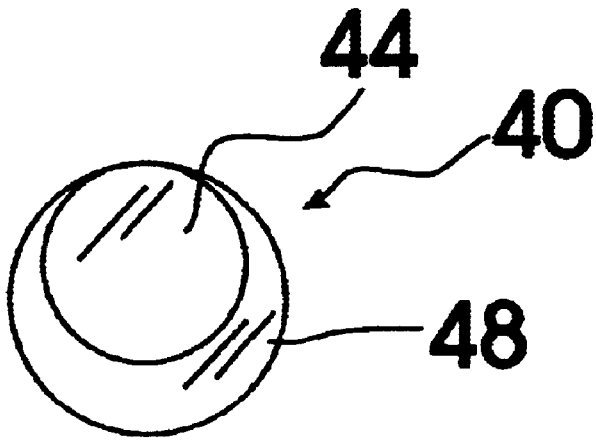
FIG. 3 is an end view of the improved hinge shaft of the stitch skip mechanism of FIG. 2.
Figure 4:
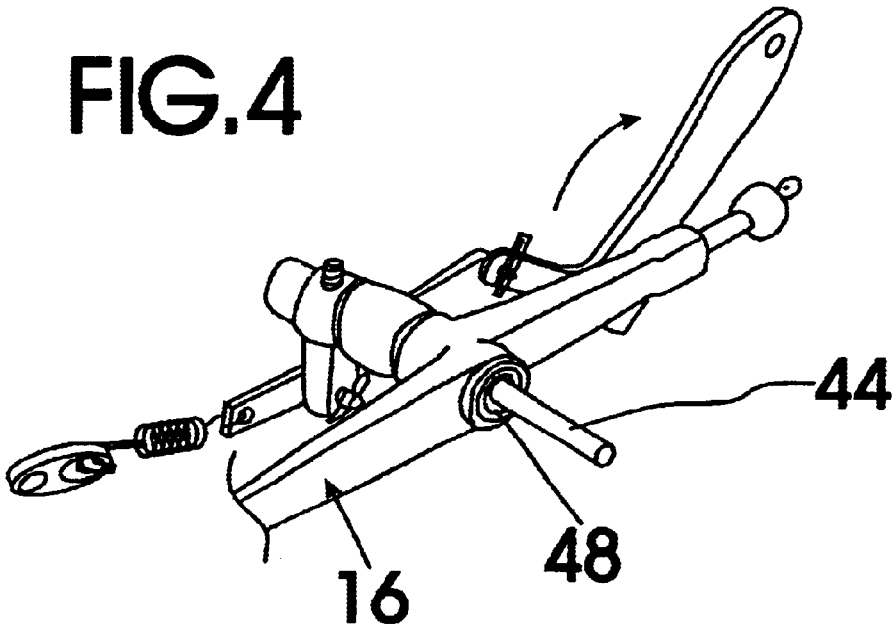
FIG. 4 is a detail perspective view of the stitch skip mechanism improvement of the present invention in connection with the representative needle bar movement mechanism of the representative chain stitch sewing machine of FIG. 1 with the improved hinge shaft in the first orientation.
Figure 5:
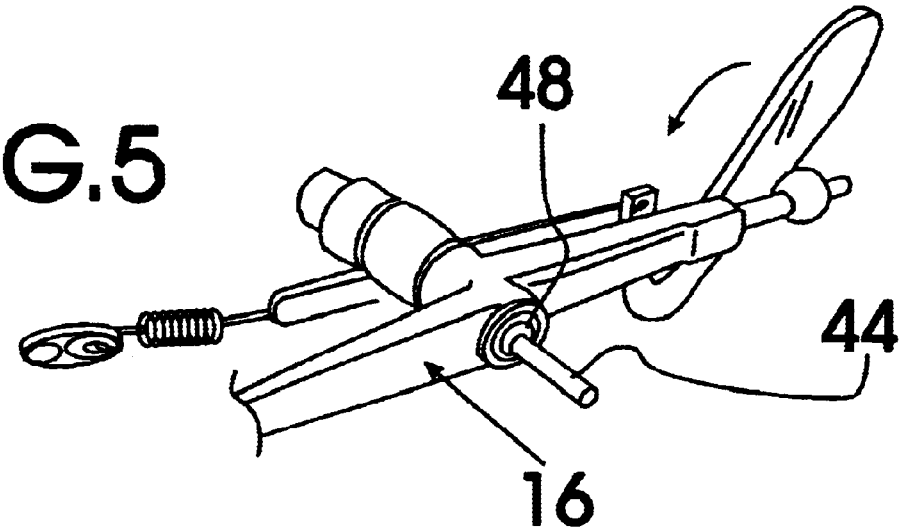
FIG. 5 is an exploded perspective view of the stitch skip mechanism improvement of the present invention in connection with the representative needle bar movement mechanism of the representative chain stitch sewing machine of FIG. 1 with the improved hinge shaft in the second orientation.

FIGS. 1–5 show various aspects of an exemplary embodiment of the stitch skip mechanism, generally designated 10, for chain stitch sewing machines of the present invention. Stitch skip mechanism 10 is adapted for use with chain stitch sewing machines that include a needle bar movement mechanism for chain stitch machine 10 that includes having a needle bar movement mechanism including a pivoting needle bar drive lever, generally designated 14, having a needle bar attachment end, generally designated 16; a pivot bushing, generally designated 18, disposed in a central portion thereof 20; and a hand wheel end, generally designated 24, mechanically linked to a drive motor through a crank shaft assembly, generally designated 30. Pivot bushing 18 pivots on a uniform diameter pivot pin 32 that is inserted through pivot bushing 18.

The improvement to chain stitch machine 10 includes providing an improved needle bar movement mechanism, generally designated 14*a*. Improved needle bar movement mechanism 14*a* is identical in most respects to needle bar movement mechanism 14 except for replacing the uniform diameter pivot pin 32 with an operator activated hinge shaft angular orientation mechanism, generally designated 40 that includes an improved hinge shaft, generally designated 42, having two concentrically oriented end sections 44,46 that are connected by an off-center bushing contact section 48. The orientation of off-center bushing contact section 48 is controllable by an operator through the use of an orientation mechanism, generally designated 41 that includes a shaft rotator 50, an operator activation lever 52, a U-shaped linkage member 54, spring coupling plate 56, a biasing spring 58, and a biasing spring anchor assembly 60. Biasing spring 58 biases the shaft rotator 50 toward a position holding the improved hinge shaft at a first orientation.

During operation, the operator may operate the chain stitch sewing machine in continuous stitching mode by allowing the improved hinge shaft 40 to remain in the first orientation. While improved hinge shaft 40 is in the first orientation (FIG. 4), the needle bar attachment end 16 of the pivoting needle bar drive lever 14 reciprocates between a normal upper and a normal lower position that causes the chain stitch sewing machine to form a chain stitch during each cycle of operation.

When the operator manipulates the operator activation lever 52 to move the improved hinge shaft 40 into the second orientation (FIG. 5), the needle bar attachment end 16 of the pivoting needle bar drive lever 14 reciprocates between a raised upper and a raised lower position that causes the chain stitch sewing machine to skip a chain stitch during each cycle of operation.

It can be seen from the preceding description that stitch skip mechanism for chain stitch machine has been provided.

It is noted that the embodiment of the stitch skip mechanism for chain stitch machine described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. In a chain stitch sewing machine that include a needle bar movement mechanism having a pivoting needle bar drive lever that includes a needle bar attachment end, a pivot bushing disposed in a central portion thereof, and a hand wheel end that is mechanically linked to a drive motor through a crank shaft assembly; and wherein the pivoting needle bar drive lever pivots on the pivot bushing through which a uniform diameter pivot pin is inserted; the improvement comprising:

replacing the uniform diameter pivot pin with an improved hinge shaft; and providing an operator activated hinge shaft angular orientation mechanism mechanically linked to the improved hinge shaft;

the improved hinge shaft having two concentrically oriented end sections connected by an off-center bushing contact section that is dimensioned such that, when the improved hinge shaft is oriented at a first orientation by the operator activated hinge shaft angular orientation mechanism, the needle bar attachment end of the pivoting needle bar drive lever reciprocates between a normal upper and a normal lower position that causes the chain stitch sewing machine to form a chain stitch during each cycle of operation; and that, when the improved hinge shaft is oriented at a second orientation by the operator activated hinge shaft angular orientation mechanism, the needle bar attachment end of the pivoting needle bar drive lever reciprocates between a raised upper and a raised lower position that causes the chain stitch sewing machine to skip a chain stitch during each cycle of operation.

* * * * *